US005950385A

United States Patent [19]

Herren

[11] Patent Number: 5,950,385

[45] Date of Patent: Sep. 14, 1999

[54] INTERIOR SHAFT WALL CONSTRUCTION

[76] Inventor: Thomas R. Herren, 1160 N. Blue Gum Ave., Anaheim, Calif. 92806

[21] Appl. No.: 09/038,311

[22] Filed: Mar. 11, 1998

[51] Int. Cl.[6] ..... E04C 2/34; E04C 3/30; E04B 2/30

[52] U.S. Cl. ..... 52/481.1; 52/481.2; 52/479; 52/489.1; 52/729.5; 52/731.5; 52/731.9

[58] Field of Search ..... 52/481.1, 481.2, 52/479, 489.1, 489.2, 712, 238.1, 729.5, 731.5, 731.9

[56] References Cited

U.S. PATENT DOCUMENTS

| | | | |
|---|---|---|---|
| 2,699,669 | 1/1955 | Nelsson | 52/481.1 |
| 2,851,740 | 9/1958 | Baker | 52/479 |
| 2,909,251 | 10/1959 | Nelsson | 52/238.1 |
| 2,958,982 | 11/1960 | Baker | 52/481.2 X |
| 3,058,551 | 10/1962 | Martin | 52/481.1 X |
| 3,320,710 | 5/1967 | Byssing | 52/481.2 |
| 3,623,290 | 11/1971 | Downing, Jr. | 52/481.2 |
| 3,712,015 | 1/1973 | Nelson | 52/481.1 X |
| 3,729,883 | 5/1973 | Thompson | 52/481.2 |
| 3,872,639 | 3/1975 | Crumbaugh et al. | 52/479 |
| 4,443,991 | 4/1984 | Mieyal | 52/481.2 X |
| 5,127,203 | 7/1992 | Paquette | 52/241 |
| 5,440,854 | 8/1995 | Hohmann | 52/489.1 |
| 5,475,961 | 12/1995 | Menchetti | 52/481.1 |

*Primary Examiner*—Carl D. Friedman
*Assistant Examiner*—Brian E. Glessner
*Attorney, Agent, or Firm*—Charles H. Thomas

[57] ABSTRACT

A seismic and fire-resistant vertical shaft wall structure is formed by employing a uniquely configured connector above wallboard panels forming the shaft wall at each vertical section of the shaft wall structure. The connectors are formed of strips of sheet metal configured in a manner to seat wallboard panels positioned atop them and receive wallboard panels projecting up from beneath them. The connectors also receive strips of resiliently compressible fire insulation material that fill the gaps between the wallboard panels and the connector at each level of the vertical shaft wall. Interior vertical shafts within buildings, such as elevator shafts, stairwells, and other shafts can be made not only fire resistant but resistant to seismic stresses as well. The system also provides a new method of constructing a superior vertical shaft wall totally from within the structure of the building, without requiring any steps to be performed from within the shaft.

17 Claims, 3 Drawing Sheets

INTERIOR SHAFT WALL CONSTRUCTION

BACKGROUND OF THE INVENTION

1. Field of the Invention

The present invention relates to a system for creating a wall for a shaft within a building that will withstand both seismic activity and fire.

2. Description of the Prior Art

It is well known in the building construction industry that elongated shafts within a building, especially vertical shafts, form tunnels through which fire can rapidly spread once a fire starts within the building. Nevertheless, such shafts are absolutely necessary to accommodate elevators, duct work, laundry chutes, and stairwells. Vertical shafts within buildings are necessary for other purposes as well.

Due to the propensity for building shafts to serve as conduits for spreading fire within a building, particular attention must be given to the construction of walls lining the shafts to attempt to make these walls as fireproof as possible. To this end many building codes currently in effect require shafts to be lined with a double thickness of fireproof wallboard. The purpose of requiring this extra thickness is to improve the barriers to the spread of fire so that they will withstand heat and flames for a longer period of time than they would if constructed of a single thickness of fire-resistant wallboard.

While the use of a double thickness of wallboard to line vertical shaft walls does enhance the fire-resistance of a shaft wall across the central, expansive wall surfaces, the mere increase in thickness of a fire-resistant barrier does not address another serious problem of making a shaft wall fire resistant. Specifically, in the construction of conventional walls of elevator shafts and other building shafts, the vertically and horizontally adjacent faces of panels of wallboard forming the surfaces of the shaft meet in abutment with each other. The interstitial crevices between the abutting surfaces are caulked with a conventional caulking material.

A conventional caulking arrangement initially provides a fireproof barrier at the delineations between the abutting wallboard panels. However, conventional caulking does deteriorate significantly over time. Furthermore, this deterioration is greatly accelerated when the building is subjected to seismic activity, such as an earthquake.

During an earthquake abutting wall panels are shaken and move both toward and away from each other and also laterally. This movement has the effect of not only dislodging the caulking, but smashing and grinding it as well. As a consequence, following an earthquake of any significant degree of severity the caulking between the abutting wallboard panels in a building shaft is shaken loose and at least parts of it are highly likely to fall out. As a result, a subsequent fire within the shaft can relatively easily escape the confines of the shaft, despite the double thickness of the wallboard, since it can transverse the shaft lining along paths between the interstitial spaces between abutting wallboard panels. The pressure built up by the expanding gases of combustion aids in forcing the fire through gaps in the caulking.

As major earthquakes in this country and elsewhere have demonstrated, earthquake building codes that were previously thought to be adequate have proven to be very inadequate. As a consequence, earthquake building code requirements have become more and more stringent. At present, in at least some locations in this country, the abutting members facing a vertical shaft, such as an elevator shaft, must be able to withstand cycling within a range of one inch toward and away from each other, and cycling of 0.93 inches laterally relative to each other. Until now there has not been any building shaft wall system that can meet the current cycling requirements for withstanding seismic activity and still maintain integrity as a barrier against the spread of fire following such cycling.

An aggravating factor that promotes the spread of a fire within a building shaft at the seams between abutting wallboard panels is that when a fire is burning within the shaft, it generates a considerable amount of smoke. This smoke is heated and expands, thereby building a substantial pressure within the shaft where the fire is burning. The pressure of smoke from a fire burning within a building shaft literally blasts the fire insulation out of the interstitial spaces between abutting wall panels, and allows the fire to spread through these spaces and into surrounding rooms. Thus, the weakened condition of conventional insulation that has been subjected to seismic activity is totally inadequate to withstand the blast of pressure from smoke and heated air that accompany a fire.

As a consequence, building shafts that have been faced with wallboard in a conventional manner and which have been subjected to seismic activity, allow a fire that reaches a shaft within as building to spread from floor to floor through the interstitial spaces between the abutting wallboard panels very rapidly. This greatly enhances the damage that a fire causes and significantly increases the peril of loss of life.

A principal object of the present invention is to provide an interior building shaft wall construction that provides an enduring fire barrier that will meet even the most stringent seismic and fire resistance code standards. Unlike conventional interior building shaft wall fabrications systems, the present invention does in fact meet the seismic resistance standards of current building code requirements and also the fire resistance standards demanded for interior building shafts. More specifically, the system of the present system allows wallboard panels to cycle vertically one inch up and down, toward and away from each other, and also 0.93 inches of cycling in lateral displacement relative to each other. Furthermore, following such seismic activity the interior building shaft wall construction system of the invention continues to meet applicable shaft wall fire resistance code standards.

The present invention provides a unique interconnection arrangement between the vertically abutting levels of interior building shaft walls.

SUMMARY OF THE INVENTION

In one broad aspect the invention is a connector for holding wallboard panels in position to form a shaft lined with wallboard panels in a building.

The connector of the invention is comprised of a metal strip that is bent transversely into a unique configuration. The metal strip forms a horizontally disposed channel web with shaft-side and wall-side extremities. The metal strip is bent to form a shaft-lining stabilizing leg. This leg is formed by a downwardly depending, doubled back fold in the metal strip at the shaft-side extremity of the web. The metal strip is also bent from the shaft-lining stabilizing leg to form a horizontally disposed shaft-lining seating platform extending inwardly from the shaft-lining stabilizing leg. The metal strip is further bent to form a shaft-lining base retainer projecting upwardly from the shaft-lining seating platform and folded back downwardly to form an upper shaft-lining retainer that projects downwardly beyond the shaft-lining seating platform. The upper shaft-lining retainer is spaced from and parallel to the shaft-lining stabilizing leg.

The metal strip is further bent on the other side of the web to form a wall-lining base retainer. This structure is formed by an upwardly projecting, doubled back fold in the metal strip at the wall-side extremity of the web. A wall-lining seating platform is formed in the metal strip to lie adjacent to the wall-lining base retainer and is formed by a horizontally projecting fold in the metal strip. An upper wall-lining stabilizing leg depends downwardly directly beneath the wall-lining base retainer and is parallel to and transversely spaced from the shaft-lining stabilizing leg. The channel web and the shaft and wall-lining stabilizing legs on opposing sides of the web form a downwardly facing channel that receives conventional, upright sheet metal building wall studs.

Conventional sheet metal building wall studs are formed of sheet metal bent into a generally "U-shaped" cross section in which a relatively broad central stud web is flanked by a pair of narrower stud sides that are bent at right angles to the stud web. The stud web typically has a uniform nominal width of either four inches or three and one half inches, and the sides of the U-shaped stud typically extend a nominal distance of two inches from the stud web. To enhance structural rigidity the edges of the sides of each metal stud are normally bent over into a plane parallel to and spaced from the plane of the stud web. These turned over edges of the stud side walls thereby form marginal lips which are typically one quarter to one half an inch in width. The finished metal stud therefore has a generally "C-shaped" cross section.

In another broad aspect the present invention may be considered to be a seismic and fire-resistant, vertical shaft wall structure. This structure is comprised of a shaft lining formed by a plurality of vertical levels including at each level a pair of vertically oriented, shaft-lining, wallboard panels. This pair of shaft-lining, wallboard panels includes a concealed panel and an exposed panel. Both of the panels in this pair have flat, mutually facing surfaces in contact with each other. The structure also includes a pair of vertically oriented wall-lining wallboard panels including an underlying and an overlying panel. The panels in this pair likewise have flat, mutually facing surfaces that reside in contact with each other. The overlying panel in the wall-lining wallboard pair of panels extends upwardly beyond the upper extremity of the underlying panel. This arrangement creates an insulation gap at the upper extremity of the pair of wall-lining wallboard panels.

In the shaft wall structure of the invention, vertically extending metal studs of the type described are disposed between and contact the pairs of panels. Also, connectors formed of metal strips are located between each of the vertical levels.

Each of the metal connectors includes a downwardly facing channel formed with a horizontal web, a shaft-lining stabilizing leg depending from one transverse side of the web, and an upper wall-lining stabilizing leg depending downwardly at the opposite transverse side of the web, and having a plurality of longitudinally spaced, vertically elongated fastener slots defined therein. Each connector further includes a horizontal shaft-lining seating platform, an upwardly projecting shaft-lining base retainer, a downwardly projecting upper shaft-lining retainer, an upwardly projecting wall-lining base retainer, and a horizontal wall-lining seating platform.

At each of the levels in the shaft wall structure of the invention the upper extremities of the pair of shaft-lining wallboard panels are inserted up beneath the shaft-lining seating platform and between the upper shaft-lining retainer and the shaft-lining stabilizing leg of the connector located immediately thereabove. The lower extremities of the pair of shaft-lining wallboard panels rest atop the shaft-lining seating platform and are secured to the shaft-lining base retainer of the connector located immediately therebeneath. The pair of wall-lining panels are disposed between the wall-lining seating platforms of the connectors located immediately thereabove and therebeneath. The pair of wall-lining panels are secured to the metal studs in contact therewith.

A layer of nonflammable, resiliently compressible fire insulation is located above the upper extremities of the shaft-lining wallboard panels. Another layer of nonflammable, resiliently compressible fire insulation is located above the upper extremities of the wall-lining panels, filling the insulation gap and extending to the wall-lining seating platform of the connector located immediately thereabove. Wall stud fasteners extend through some of the fastener slots in the upper wall stabilizing legs of the connectors and into the metal studs. Vertically disposed standoff washers are interposed between the wall stud fasteners and the metal studs.

Due to the resiliently compressible fire insulation located between both the pair of wall-lining wallboard panels and the pair of shaft-lining wallboard panels and the connector immediately thereabove, a resiliently compressible fire insulation barrier is formed at the transition between each of the vertically stacked levels of wallboard panels. The resiliently compressible nature of the fire insulation ensures that despite its ability to withstand compression and expansion due to seismic activity, the fire insulation retains its integrity as a barrier to fire. The system for fastening the connectors to the upright metal studs, employing vertically elongated slots and standoff washer for securing the connectors to the studs located therebeneath also aids in meeting even the most stringent seismic code requirements.

Due to the unique construction of the connector at each vertical level within the length of the shaft, the seismic and fire-resistant vertical shaft wall structure of the invention may be built with remarkable ease. Also, the nature of the structure is such that it can be built entirely without any access to the interior of the shaft.

In still another broad aspect the invention may be considered to be a method of lining a vertical, interior shaft with a fire-resistant lining. The steps of the method include delineating the building shaft into a plurality of vertically stacked levels. A level connector is placed at each transition between the levels. The level connectors hold the wallboard panels in position.

Each level connector is formed from a metal strip bent transversely to form a horizontally disposed channel web with opposing shaft-side and wall-side extremities.

A shaft-lining stabilizing leg is formed by a downwardly depending doubled back fold at the shaft-side extremity of the web. A horizontally disposed shaft-lining seating platform extends inwardly from the shaft-lining stabilizing leg. A shaft-lining base retainer projects upwardly from the shaft-lining seating platform and is folded back downwardly to form an upper shaft-lining retainer that projects downwardly beyond the shaft-lining seating platform. The shaft-lining retainer is spaced from and parallel to the shaft-lining stabilizing leg. Each connector is also formed with a wall-lining base retainer formed by an upwardly projecting, doubled back fold in the metal strip at the wall-side extremity of the web, a wall-lining seating platform formed by a horizontally projecting fold in the metal strip adjacent the wall-lining base retainer, and an upper, wall-lining stabilizing leg depending downwardly directly beneath the wall-lining base retainer parallel to and transversely spaced from the shaft-lining stabilizing leg.

According to the invention at least one sheet of shaft-lining, fire-resistant wallboard is provided at each of the levels. A layer of nonflammable fire insulation is placed above the at least one sheet of shaft-lining, fire-resistant wallboard sheet. The top of this at least one sheet of shaft-lining, fire-resistant wallboard is inserted up between the shaft-lining stabilizing leg and the upper shaft-lining retainer of an upper level connector located at the transition with the level immediately thereabove. The at least one sheet of shaft-lining, fire-resistant wallboard is secured to the shaft-lining base retainer of a lower level connector located at the transition with the level immediately therebelow.

A plurality of horizontally spaced, vertically oriented metal studs, each having upper and lower extremities, are inserted in between the channel webs of the upper and lower level connectors. The lower ends of the upright metal studs are secured to the shaft-lining base retainer of the lower lever connector. The wall-lining stabilizing leg of the upper level connector is secured to the upper ends of the metal studs. An underlying wall-lining wallboard panel is placed atop the wall-lining seating platform and in contact with the wall-lining base retainer of the lower level connector and against the upright metal studs.

An overlying wall-lining wallboard panel is placed atop the wall-lining seating platform of the lower level connector and in contact with the underlying wall-lining wallboard panel. The overlying wall-lining wallboard panel extends upwardly beyond the upper extremity of the underlying wall-lining wallboard panel to create a wall-lining insulation gap between the pair of wall-lining wallboard panels and the underside of the wall-lining seating platform of the upper level connector. This gap is greater above the overlying panel than the underlying panel. The underlying and overlying wall-lining panels are secured to the upright metal studs. The wall-lining insulation gap is filled with a layer of nonflammable, resiliently compressible fire insulation.

The method of the invention is advantageous in that the construction of the interior building shaft can be performed completely from the outside of the shaft at each of the different floor levels. As a consequence, no work needs to be performed from within the shaft itself. This greatly improves the ease and speed with which the building shaft wall can be created.

In the practice of the method of the invention a single shaft-lining wallboard panel could be employed if it is thick enough to meet building codes. Most building codes typically require fire-resistant wallboard panelling at the exposed surface of the wall facing the shaft to be at least one inch in thickness. While wallboard panels with such a thickness can be manufactured, they are extremely heavy and difficult to manipulate. As a consequence, more typically the requisite thickness is achieved by utilizing a pair of wallboard panels to form the shaft lining. Preferably, a pair of wallboard panels each five-eighths of an inch in thickness are placed face to face, and inserted up between the shaft-lining stabilizing leg and the upper shaft-lining retainer of the connector above. The pair of shaft-lining wallboard sheets are held and reside in mutually facing contact throughout.

The present invention provides a unique interaction of elements that greatly enhances the fire resistance capabilities of an interior building shaft wall structure, yet still retains extraordinary seismic resistant capabilities. The interior shaft wall system of the present invention will withstand seismic testing that meets the most stringent building code seismic resistance specifications due to the use of the standoff washers that fasten the connectors to the metal studs, coupled with the elongated slots in the connectors that receive the standoff washers and fasteners that project therethrough.

The shaft wall structure system of the invention achieves a fire resistance capability that exceeds even the most stringent code specifications for fire testing due to the unique, compressible, fire resistant insulation material employed in the cavities immediately above pairs of wallboard panels forming the shaft wall structure and beneath the sheet metal connectors located immediately above these panels. Strips of this same material are applied along gaps between the upper edges of the wallboard panels and the connectors immediately thereabove on both sides of the wall. These strips are inserted or tucked into gaps created to receive them. The gaps at the wall side of the shaft wall structure are created by an offset between a double thickness of wallboard at the top of the wall. This mineral fiber insulation material is not only fire resistant, but is resiliently compressible, and thus will withstand seismic activity without damage by compression and expansion as required.

The invention may be described with greater clarity and particularity by reference to the accompanying drawings.

DESCRIPTION OF THE EMBODIMENT

Figure 2:
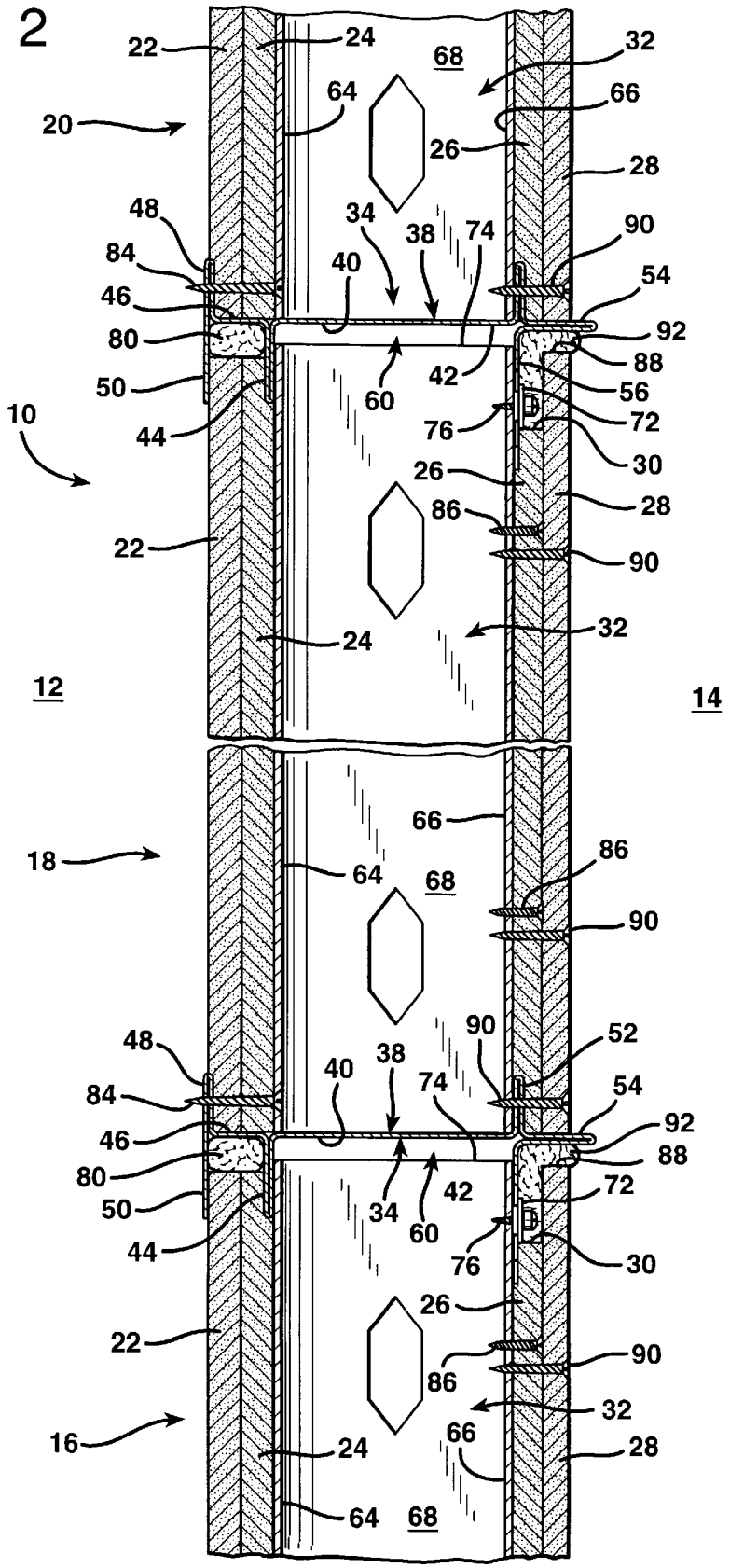
FIG. 2 is a sectional elevational view illustrating a seismic and fire-resistant, vertical wall structure constructed according to the invention.

As illustrated in FIG. 2, a seismic and fire-resistant, vertical shaft wall structure is comprised of a shaft lining indicated generally at 10 that delineates one of the surfaces of a vertical shaft 12 from the interior of the building indicated at 14. The shaft lining 10 is formed of a plurality of vertical levels, including the levels 16, 18, and 20 illustrated in FIG. 2, as well as identical levels located above the level 20 and below the level 16. Each of these levels is about nine feet in height.

Each of the vertically delineated levels includes a pair of vertically oriented shaft-lining, wallboard panels 22 and 24. Each vertical panel 22 is a rectangular sheet panel five-eighths of an inch in thickness formed of conventional, fire-resistant gypsum wallboard. The sheets 22 are exposed in that they form delineating surfaces of the interior of the elevator shaft 12. Each shaft-lining wallboard panel 24 is of the same size, shape, and construction as each panel 22, but is concealed from view. The shaft-lining, wallboard panels are arranged in pairs at each of the levels 16, 18, and 20. The shaft-lining wallboard panels 22 and 24 in each pair have flat, mutually facing surfaces that reside in mutually facing contact throughout.

The shaft lining 10 also includes at each vertical level a pair of vertically oriented, wall-lining, wallboard panels 26 and 28. Each underlying wall-lining, wallboard panel 26 is also formed of a rectangular sheet of conventional fire-resistant gypsum wallboard five-eighths of an inch in thickness. Each overlying wall-lining wallboard panel 28 is also formed of the same fire-resistant gypsum wallboard sheet material as each panel 26 and is also rectangular in configuration. However, the overlying panel 28 extends upwardly beyond the upper edge 30 of the underlying panel 26 to create an inverted, L-shaped insulation gap.

At each vertical level of the vertical shaft wall structure 10 a plurality of vertically extending metal studs 32 are disposed between and contact both the pair of shaft-lining wallboard panels 22 and 24 and the pair of wall-lining wallboard panels 26 and 28. Connectors 34, formed of sheet metal strips, are located between each of the vertical levels 16, 18, and 20, as well as the other vertical levels extending above and beneath the section of shaft wall structure 10 depicted in FIG. 2.

Figure 1:
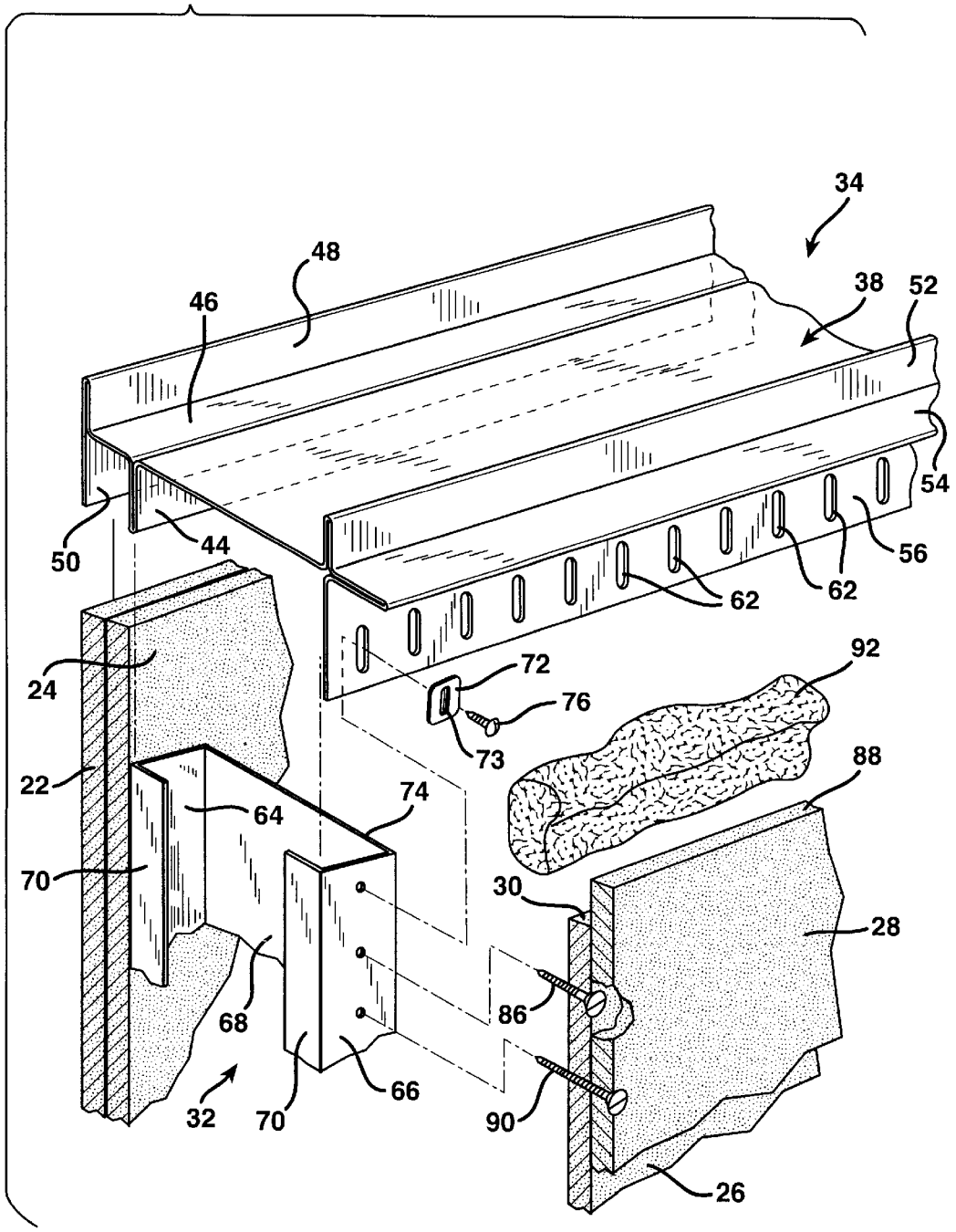
FIG. 1 is an exploded perspective view illustrating the structural details at the interconnection between the tops of pairs of shaft-lining and wall-lining wallboard panels and a connector immediately thereabove in the construction of an interior building shaft.
Figure 3:
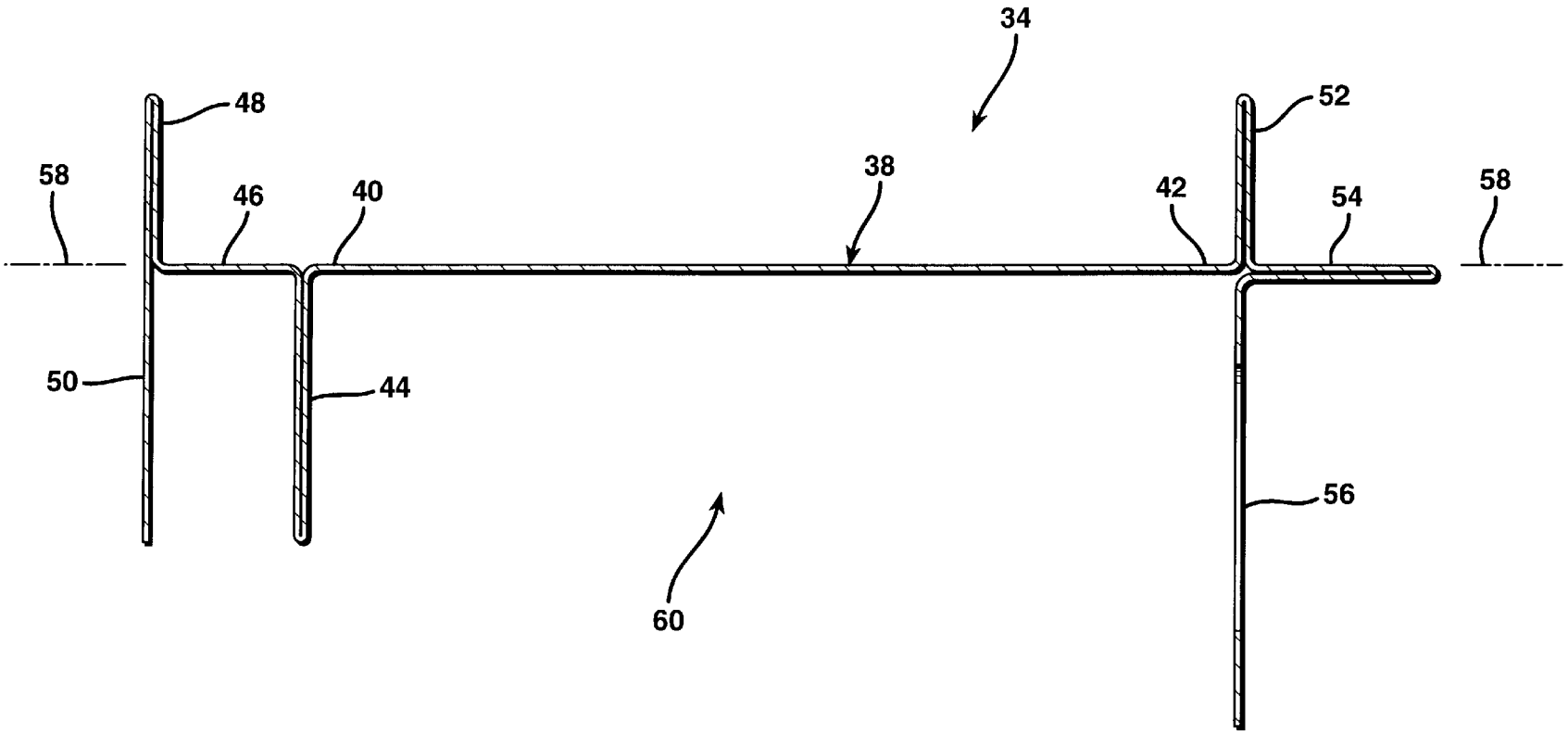
FIG. 3 is a cross-sectional view illustrating the sheet metal connector strip constructed according to the invention in isolation.

The structure of each connector 34 is depicted in isolation in FIGS. 1 and 3.

Each connector 34 is formed of a sheet metal strip which may vary between twenty gauge and 16 gauge galvanized steel. The sheet metal strip from which each connector 34 is formed is originally about eighteen and a half inches wide, although the width may vary depending upon the width of the metal studs 32. The connectors 34 are bent transversely throughout their lengths at specific locations in a unique fashion to interconnect the repeating components of the vertical shaft wall structure 10 at each vertical level.

As illustrated in FIGS. 1 and 3, the metal strip forming each connector 34 is bent at transverse locations across the width thereof to form a horizontally disposed channel web 38 with a shaft-side extremity 40 and a wall- side extremity 42. The transverse width of the web 38 may be anywhere from one to five inches, depending upon the width of the vertically extending metal studs 32.

Each connector 34 is bent to form a shaft-lining, stabilizing leg 44 that is created by a downwardly depending doubled back fold in the metal strip at the shaft-side extremity 40 of the channel web 38. The shaft-lining, stabilizing leg 44 preferably depends beneath the horizontal channel web 38 a distance of about one and a half inches.

Next to the depending shaft-lining stabilizing leg 44, the metal strip forming the connector 34 is bent to form a horizontally disposed, shaft-lining seating platform 46 which is preferably about one inch in width. The shaft-lining seating platform 46 extends inwardly toward the shaft 12 from the shaft-lining stabilizing leg 44 and is bent upwardly to form a vertically extending, shaft-lining base retainer 48. The shaft-lining base retainer 48 projects upwardly from the shaft-lining seating platform 46 a distance of about one inch. The metal strip forming the connector 34 is folded back downwardly from the shaft-lining base retainer 48 to form an upper shaft-lining retainer 50 that projects downwardly beyond the shaft-lining seating platform 46 a distance of about one and an half inches. The upper shaft-lining retainer 50 is spaced from the shaft-lining stabilizing leg 44 a distance of about one and one-eighth inches, due to the thickness of the metal strip forming the metal connector 34. The upper shaft-lining retainer 50 is parallel to the shaft-lining stabilizing leg 44.

At the opposing wall-side extremity 42 of the channel web 38 a wall-lining base retainer 52 is formed by an upwardly projecting doubled back fold in the metal strip. The wall-lining base retainer 52 extends upwardly from the wall-side extremity 42 of the web 38 above the upper surface of the channel web 38 a distance of about one inch.

Adjacent the wall-lining base retainer 52 the metal strip is bent to form a wall-lining seating platform 54. The wall-lining seating platform 54 extends horizontally from the bottom of the wall-lining base retainer 52 a distance of about one and one-quarter inches. The metal strip is folded downwardly directly beneath and parallel to the wall-lining base retainer 52 to form an upper wall-stabilizing leg 56. The upper wall-stabilizing leg 56 depends downwardly directly beneath the wall-lining base retainer 52 a distance of about two and a half inches.

The shaft-lining seating platform 46, the channel web 38, and the wall-lining seating platform 54 all have flat, upwardly facing surfaces that lie in horizontal, coplanar relationship with each other in a horizontal plane indicated at 58 in FIG. 3. The shaft-lining base retainer 48 and the wall-lining base retainer 52 extend upwardly from the upper surfaces of the shaft-lining seating platform 46, the channel web 38, and the wall-lining seating platform 54 a distance of about one inch. The upper wall-lining stabilizing leg 56 is spaced from and parallel to the shaft-lining stabilizing leg 44, both of which are vertically oriented and are perpendicular to the channel web 38.

The shaft-lining stabilizing leg 44 and the upper wall-lining stabilizing leg 56 together with the channel web 38, form a concave, downwardly facing channel 60 that receives the upper ends of the vertically oriented metal studs 32. The shaft-lining base retainer 48 and the wall-lining base retainer 52 are separated from each other by a distance of from between about two inches and about six inches depending upon the width of the metal studs 32.

As illustrated in FIG. 1, the upper wall-lining stabilizing legs 56 of each of the connectors 34 are fabricated with vertically elongated stud fastener openings 62 defined therethrough. The stud fastener openings 62 are each preferably about one and one-quarter inches in length, one-quarter inch in width, and are spaced longitudinally from each other at regular one and one-half inch intervals. The slots 62 are centered within the upper wall-lining stabilizing legs 56 and are oriented in a vertical direction perpendicular to the channel web 38.

Each of the metal studs 32 has a height about one inch shorter than the distance between the vertical levels 16, 18, and 20. In a typical building construction, each of 15; the metal studs 32 may be about one hundred seven and a half inches in height. In a typical installation each of the metal studs 32 is formed three and five-eighths inches in depth from 0.019 inch thick galvanized steel. The metal studs 32 may be located twenty-four inches on center, maximum, but are more typically spaced at sixteen inch intervals. Each of the studs 32 is formed from a single sheet metal structure bent into a configuration having stud side walls 64 and 66 of uniform width. The stud side walls 64 and 66 are bent perpendicularly out from a relatively broad, central stud web 68. The edges of the side walls 64 and 66 remote from the stud web 68 are turned over to form marginal lips 70 which enhance the structural rigidity of the studs 32. The studs 32 thereby have a generally "C-shaped" cross-section, as illustrated.

The studs 32 are very slightly narrower than the channels 60 formed in the connectors 34. Therefore, the upright side walls 64 and 66 of the studs 32 fit snugly within the space between the shaft-lining stabilizing legs 44 and the upper wall-lining stabilizing legs 56 of the channels 60 at the undersides of the connectors 34. The connectors 34 extend across the upper ends of the studs 32 so that the shaft-lining stabilizing legs 44 and the upper wall-lining stabilizing legs 56 capture and embrace the side walls 64 and 66 of the studs 32, as best illustrated in FIG. 2.

Standoff washers 72 are provided for each of the vertically elongated upper wall-lining stabilizing leg fastener slots 62 that is aligned with a stud side wall 66 of a stud 32. Each standoff washer 72 is a flat, preferably rectangular structure having an elongated slot defined therein. Standoff washers are preferably about seven-eighths of an inch in width and about three-quarters of an inch in length. The longitudinal slot 73 defined therein is preferably about three-eighths of an inch in length. In the formation of the slots 73 the structure of the standoff washer 72 is deformed so as to provide a pair of ribs or lips that extend out from the otherwise planar structure of the standoff washer 72 a distance of about one-sixteenth of an inch. The lips extend longitudinally along the sides of the elongated slots 73.

The structure and manner of operation of the standoff washers 72 is illustrated and described in U.S. Pat. No. 5,467,566. Specifically, a standoff washer 72 is positioned in each of the elongated fastener slots 62 residing in alignment with a stud 32 such that the lips of the standoff washer 72 extend through the thickness of the upper wall-lining stabilizing leg 56, and protrude a very short distance therebeyond.

The studs 32 are cut to lengths so that their horizontal, upwardly facing edges 74 terminate slightly below the channel web 38 of the connector 34 immediately thereabove. Preferably, a clearance of about one-half of an inch exists between the upper edges 74 at the tops of the studs 32 and the undersurface of the channel web 38.

The upper extremities of the studs 32 are fastened to the upper wall-lining stabilizing leg 56 using standoff washers 72 and one-half inch length, pan head, self drilling or self-tapping no. 6 sheet metal framing screws 76. A standoff washer 72 is positioned at the center of each slot 62 that is aligned with a stud 32. The standoff washer 72 is centered within the slot 62 and placed thereagainst so that the lips on each side of the standoff washer slot 73 project through the structure of the upper wall-lining stabilizing leg 56. The standoff washer lips project slightly beyond the thickness of the sixteen to twenty-gauge stock forming the connectors 34 so as to reside in contact with the side walls 66 of each stud 32.

The stud fastening screws 76 are then power driven through the standoff washer slots 73 into the structure of the stud side walls 66 therebeyond, thereby forming stud fastener openings therein. By securing the studs 32 to the upper wall-lining stabilizing legs 56 in this manner, the studs 32 are securely fastened to the connectors 34. Nevertheless, the standoff washers 72 and the vertically elongated slots 62 permit a limited amount of relative vertical movement between the studs 32 and the connectors 34, thereby providing resistance to seismic activity. The functions of the standoff washers 72 and the stud fastening slots 62 in this regard are described in U.S. Pat. No. 5,467,566 and in U.S. Pat. No. 5,127,203, respectively, both of which are hereby incorporated by reference.

The assembly of the shaft wall structure 10 is best described with reference to FIGS. 1 and 2. In the construction of the building the connectors 34 are first secured in position relative to the building frame at each vertically sequential level 16, 18, and 20 of the building within which the shaft 12 is formed. Therefore, prior to creation of the shaft 12, the connectors 34 are already secured in position relative to the building framework.

To form the shaft wall structure 10, at each of the levels 16, 18, and 20, as well as the levels above and below, the exposed wallboard panel 22 is first maneuvered into position from within the building 14. More specifically, the upper end of the wallboard panel 22 is inserted up between the upper shaft-lining retainer 50 and the shaft-lining stabilizing leg 44 of the connector 34 at the top of the level of the interior building shaft wall structure 10 to be installed. The height of the shaft-lining wallboard sheet 22 is such that the upper end thereof resides and is entrapped between the upper shaft-lining retainer 50 and the shaft-lining stabilizing leg 44, although about a one-half inch gap exists above the upper end of the wallboard sheet 22 and the underside of the shaft-lining seating platform 46 of the connector 34 thereabove.

The lower end of the wallboard sheet 22 is then swung toward the shaft-lining base retainer 48 of the connector 34 which is located at the bottom of the level at which the panel 22 is being installed. The panel 22 thereupon resides in contact with the surface of the shaft-lining base retainer 48 opposite the shaft 12. That is, the wallboard panel 22 rests atop the shaft-lining seating platform 46 of the connector 34 at the bottom of the level at which it is being installed and in contact with the surface of the shaft-lining base retainer 48 immediately adjacent thereto.

At this point it is important to fill the gap above the wallboard panel 22 with fire-proof insulation. An elongated strip 80 of nonflammable, mineral fiber insulation called safing is inserted into the space above the exposed shaft-lining wallboard panel 22. The mineral fiber substance forming the insulation strip 80 is a fire-proof material that is produced as a by-product of slag. It is heated and spun and resembles spun fiberglass in texture, although it is dark brown in color. More importantly, it is a spongy, resiliently compressible material that does not become brittle with age or exposure to temperature extremes. Furthermore, it is extremely low in cost.

For ease of installation, the insulation strip 80 may be inserted into the space above the wallboard panel 22 after the top of the panel 22 has been inserted up between the shaft-lining stabilizing leg 44 and the upper shaft-lining retainer 50 of an upper level connector 34 delineating the top of the level at which the panel 22 is installed. Next, the second shaft-lining wallboard panel 24 is also inserted up between the shaft-lining stabilizing leg 44 and the panel 22, and thus also the upper shaft-lining retainer 50 of the connector 34 at top of the level at which the shaft-lining wallboard panel 24 is to be installed. The foot, or base, of the shaft-lining wallboard panel 24 is thereupon swung over into contact with the exposed panel 22, so that the pair of wall-lining wallboard panels 22 and 24 reside in face-to-face disposition, in intimate contact with each other throughout their heights. The wallboard panels 22 and 24 are of the same dimensions throughout.

As the concealed wallboard panel 24 is moved into position, the fire insulation strip 80 is resiliently compressed between the underside of the shaft-lining seating platform 46 of the upper connector 34 and the top edges of the wall-lining wallboard panels 22 and 24 and laterally between the upper shaft-lining retainer 50 and the shaft-lining stabilizing leg 44 of the connector 34 at the top of the level of installation. Preferably, the insulation strip 80 is of a cross-section such that it is compressed to about half of the height it has in its uncompressed state and to about half of its width in an uncompressed state.

Once the shaft-lining wallboard panels 22 and 24 are both in position, the studs 32 are moved into position. Specifically, the upper ends 74 of the studs 32 are inserted up between the shaft-lining stabilizing leg 44 and upper wall-lining stabilizing leg 56 of the connector 34 at the top of the level, and between the facing surface of the shaft-lining wallboard panel 24 and the wall-lining base retainer 52 of the connector 34 at the bottom of the level. The studs 32 can clear the end of the upper wall-lining stabilizing leg 56 of the connector above and the wall-lining base retainer 52 of the connector 34 below. This is done by tilting the studs 32 about an axis perpendicular to the shaft-lining wallboard panels 22 and 24, and then straightening the studs 32 into a vertical orientation once they have cleared the wall-lining base retainer 52 of the connector 34 immediately therebeneath and the upper wall-lining stabilizing leg 56 of the connector 34 immediately thereabove.

No. 6, one inch long "L"-type drywall screws 84 are then driven through the side walls 64 of the studs 32 at the bases thereof about one-half inch up from the upwardly facing surface of the channel web 38 of the connector 34 therebeneath. The screws 84 are self-tapping screws that secure the side walls 64 of the studs 32 to the pair of shaft-lining wallboard sheet 22 and 24, as illustrated in FIG. 2 and to the shaft-lining base retainer 48 therebeyond. A single screw 84 is driven through each of the stud side walls 64, through the lower ends of the adjacent shaft-lining wallboard panels 24 and 22, and through the shaft-lining base retainer 48.

The screws 76 and standoff washers 72 are then utilized to secure the upper wall-lining stabilizing leg 56 of the top connector 34 at each level to the upper end of the stud 32 immediately therebeneath. As previously indicated, the top edge 74 of each stud 32 terminates about one-half inch beneath the downwardly facing underside surface of the channel web 38 of each panel 60.

Once the studs 32 have been secured to the connectors 34 immediately thereabove and therebeneath by the screws 76 and 84, respectively, a pair of wall-lining wallboard sheets 26 and 28 are sequentially moved into position against the side walls 66 of the studs 32. In this connection the underlying wall-lining wallboard sheet 26 is first moved into position. No. 6 "L"-type drywall screws 86 are utilized to secure the underlying wall-lining wallboard panel 26 in position against the side walls 66 of the studs 32. The screws 86 are placed at approximately twelve-inch intervals on center along the length of each stud 32.

The overlying wall-lining wallboard sheets 28 are then moved into position in face-to-face contact with the underlying wallboard sheets 26 as illustrated in FIG. 2. Both of the wall-lining wallboard sheets 26 and 28 are five-eighths of an inch in thickness, but the upper end 88 of the overlying wall-lining wallboard panel 28 extends upwardly beyond the upper edge 30 of the underlying wall-lining wallboard panel 26 a distance of approximately one inch.

As shown in FIG. 2, the underlying wall-lining wallboard panels 26 are placed atop the wall-lining seating platforms 54 and in contact with the wall-lining base retainer 52 of the lower level connector 34 at the bottom of the level at which the wallboard panels 26 and 28 are being installed. The underlying wall-lining wallboard panel 26 also reside in contact against the side walls 66 of the upright studs 32.

The overlying wallboard panels 28 are then placed atop the same wall-lining seating platform 54 of the lower lever connector 34 at the bottom of the level at which the panels 26 and 28 are being installed. The overlying wall-lining wallboard panels 28 reside in contact with the underlying wall-lining wallboard panels 26 so that the overlying wall-lining wallboard panels 28 extend upwardly beyond the upper edges 30 of the underlying panels 26 by a distance of about one inch to create a wall-lining insulation gap between the wall-lining wallboard panels 26 and 28 and the underside of the wall-lining seating platform 54 of the connector 34 at the top of the level at which the wallboard panels 26 and 28 are being installed. The width of the gap above the upper ends of the wall-lining wallboard panels 26 is greater than the width of the gap above the overlying panels 28.

The underlying and overlying wall-lining wallboard panels 26 and 28 are then secured to the upright metal studs 32 and to the wall-lining base retainer 52 of the lower level connector 34 atop which the panels 26 and 28 rest using self-tapping, number 6, one and a half inch, L-type drywall screws 90. The screws 90 are placed at approximately twelve-inch intervals on center along the lengths of the studs 32.

The wall-lining insulation gap above the upper ends of the wall-lining wallboard panels 26 and 28 is then filled with another strip 92 of the same mineral fiber safing material that is used to form the strip 80. Preferably the gap between the upper edge 88 of the upper end of the overlying wall-lining wallboard panel 28 and the downwardly facing surface of the wall-lining seating platform 54 of the connector 34 located immediately thereabove is about three-quarters of an inch.

Once the wall-lining wallboard panels 26 and 28 have been fastened to the upright studs 32 as previously described, the continuous strips 92 of mineral fiber safing are packed into the spaces formed by the gaps between the upper edges of the wallboard panels 26 and 28 and the undersurface of the wall-lining seating platform 54 located immediately thereabove. Each safing strip 92 preferably has a rectangular configuration in an uncompressed state about two inches wide and about three inches high before it is packed into position in the gaps between the upper edges of the wall-lining wallboard panels 26 and 28 and the underside of the wall-lining seating platform 54 of the connector 34 located immediately thereabove.

The gaps between the upper edges of the wall-lining wallboard panels 26 and 28 create open spaces each having the general configuration of an inverted "L". Because the overlying wall-lining wallboard panels 28 project upwardly beyond the upper edges 30 of the underlying wall-lining wallboard panels 26 a distance of threequarters of an inch, the mineral fiber strips 92 remain in place in the position depicted in FIG. 2, and do not become dislodged therefrom despite repeated cyclical movement of the studs 32 relative to the connectors 34 thereabove. Because they are resilient, the mineral fiber strips 92 are not damaged even though they are repeatedly compressed and expand with the cyclical movement to which the shaft wall structure 10 is subjected, even in a severe earthquake.

The shaft wall structure 10 will withstand a seismic cycling test that surpasses the seismic cycling test specified by Underwriter's Laboratories. That test requires the system to cycle one inch vertically and 0.93 inches horizontally in a direction perpendicular to the transverse plane of FIG. 2. The shaft wall structure 10 more than meets this specification. Despite the extreme relative movement between the vertically oriented studs 32 and the connectors 34 located immediately thereabove, the fasteners 76, 86, and 90 remain secure as do the mineral fiber insulation strips 80 and 92.

It is significant that the mineral fiber insulation strips 80 and 92 reside in contact with the upper edges of the shaft-lining wallboard panels 22 and 24 and the wall-lining wallboard panels 26 and 28, respectively, on both sides of the shaft wall structure 10, both the side facing the shaft 12 and the side facing the interior of the building 14. The partially compressed mineral fiber strips 80 and 92 ensure that no lateral fire channels form above the pairs of wallboard panels 22,24 and 26,28. Since the strips 80 and 92 are formed of a compressible, spongy, fire-proof material, no lateral channels through which fire and smoke can travel form across the shaft wall structure 10.

The weight of the wallboard panels 22,24 and 26,28 is sufficient to ensure that they remain in intimate contact with the shaft-lining seating platforms 46 and wall-lining seating platforms 54 atop which they respectively reside. This prevents any fire channels from forming beneath the wallboard panel pairs 22,24 and 26,28.

Undoubtedly, numerous variations and modifications of the invention will become readily apparent to those familiar with fire retardant and seismic resistant building shaft wall structures. For example, the dimensions and specifications of the panels, fastener types, fastener sizes, fastener spacing, stud sizes, stud spacing and the sizes of the elements formed in the connector of the invention may vary considerably. Accordingly, the scope of the invention should not be construed as limited to the specific embodiment or manner of implementation of the invention described.

I claim:

1. A connector for holding wallboard panels in position to form a shaft lined with wallboard panels in a building comprising: a metal strip bent at transverse locations to form a horizontally disposed channel web with shaft-side and wall-side extremities, a shaft-lining stabilizing leg formed by a downwardly depending doubled back fold in said metal strip at said shaft-side extremity of said web, a horizontally disposed shaft-lining seating platform extending inwardly from said shaft-lining stabilizing leg, a shaft-lining base retainer projecting upwardly from said shaft-lining seating platform and folded back downwardly to form an upper shaft-lining retainer that projects downwardly beyond said shaft-lining seating platform and which is spaced from and parallel to said shaft-lining stabilizing leg, a wall-lining base retainer formed by an upwardly projecting doubled back fold in said metal strip at said wall-side extremity of said web, a wall-lining seating platform adjacent said wall-lining base retainer formed by a horizontally projecting fold in said metal strip, and an upper wall-lining stabilizing leg depending downwardly directly beneath said wall-lining base retainer parallel to and transversely spaced from said shaft-lining stabilizing leg.

2. A connector according to claim 1 wherein said shaft-lining seating platform, said channel web and said wall-lining seating platform all have flat, upwardly facing surfaces that lie in horizontal coplanar relationship with each other.

3. A connector according to claim 2 wherein said shaft-lining stabilizing leg and said upper shaft-lining retainer are separated from each other by a distance of about one and one-eighth inches.

4. A connector according to claim 2 wherein said wall-lining seating platform is about one and one-quarter inch in width.

5. A connector according to claim 2 wherein said shaft-lining stabilizing leg extends downwardly from said channel web a distance of about one and one-half inches and said upper shaft-lining retainer extends downwardly from said shaft-lining seating platform a distance of about one and one-half inches.

6. A connector according to claim 2 wherein said shaft-lining base retainer and said wall lining base retainer extend upwardly from said upper surfaces of said shaft-lining seating platform, said channel web, and said wall-lining seating platform a distance of about one inch.

7. A connector according to claim 6 wherein said shaft-lining base retainer and said wall-lining base retainer are separated from each other by a distance of from between about two inches and about six inches.

8. A connector according to claim 2 wherein said upper wall-lining stabilizing leg is about two and a half inches in length.

9. A connector according to claim 1 formed of sheet steel of from twenty gauge to sixteen gauge thickness.

10. A seismic and fire-resistant vertical shaft wall structure comprising a shaft-lining formed by a plurality of vertical levels including at each level a pair of vertically oriented shaft-lining wallboard panels including a concealed and an exposed panel having flat, mutually facing surfaces in contact with each other, a pair of vertically oriented, wall-lining, wallboard panels including an underlying and an overlying panel having flat, mutually facing surfaces in contact with each other, wherein said overlying panel extends upwardly beyond the upper extremity of said underlying panel to create an insulation gap, vertically extending metal studs disposed between and contacting said pairs of panels, and connectors formed of metal strips located between each of said vertical levels, each of said connectors including a downwardly facing channel formed with a horizontal web, a shaft-lining stabilizing leg depending from one transverse side of said web, an upper wall-lining, stabilizing leg depending downwardly at the opposite transverse side of said web, and having a plurality of longitudinally spaced, vertically elongated fastener slots defined therein, a horizontal shaft-lining seating platform, a shaft-lining base retainer projecting upwardly from said shaft-lining seating platform and folded back downwardly to form an upper shaft-lining retainer, a wall-lining base retainer formed by an upwardly projecting doubled back fold in said channel web, and a wall-lining seating platform projecting horizontally from said wall-lining base retainer in coplanar relationship with said channel web, wherein at each of said levels the upper extremities of said pair of shaft-lining wallboard panels are inserted up beneath said shaft-lining seating platform and between said upper shaft-lining retainer and said shaft-lining stabilizing leg of the connector located immediately thereabove, and the lower extremities of said pair of shaft-lining wallboard panels rest atop said shaft-lining seating platform and are secured to said shaft-lining base retainer of the connector located immediately therebeneath, and said pair of wall-lining panels are disposed between said wall-lining seating platforms of the connectors located immediately thereabove and therebeneath and are secured against said metal studs, and a layer of nonflammable, resiliently compressible fire insulation located above said upper extremities of said shaft-lining wallboard panels, and a layer of nonflammable, resiliently compressible fire insulation located above said upper extremities of said wall-lining wallboard panels, filling said insulation gaps and extending to said wall-lining seating platform of said connector located immediately thereabove, wall stud fasteners extending through some of said fastener slots in said upper wall-lining stabilizing legs and into said metal studs, and vertically disposed standoff washers interposed between said wall stud fasteners and said metal studs.

11. A shaft wall structure according to claim 10 wherein said fire insulation above said upper extremities of said shaft-lining wallboard panels and said fire insulation filling said insulation gap above said upper extremities of said wall-lining wallboard panels is formed of mineral fiber.

12. A shaft wall structure according to claim 11 wherein said overlying wall-lining wallboard panel extends upwardly beyond the upper edge of said underlying wall-lining wallboard panel a distance of at least one inch.

13. A shaft wall structure according to claim 10 wherein each of said wallboard panels is about five-eighths of an inch in thickness.

14. A method of lining a vertical interior building shaft with a fire-resistant lining comprising:

delineating said building shaft into a plurality of vertically stacked levels, placing at each transition between said levels a level connector for holding wallboard panels in position that includes a metal strip bent transversely to form a horizontally disposed channel web with opposing shaft-side and wall-side extremities, a shaft-lining stabilizing leg formed by a downwardly depending doubled back fold in said metal strip at said shaft-side extremity of said web, a horizontally disposed shaft-lining seating platform extending inwardly from said shaft-lining stabilizing leg, a shaft-lining base retainer projecting upwardly from said shaft-lining seating platform and folded back downwardly to form an upper shaft-lining retainer that projects downwardly beyond said shaft-lining seating platform and which is spaced from and parallel to said shaft-lining stabilizing leg, a wall-lining base retainer formed by an upwardly projecting doubled back fold in said metal strip at said wall side of said web, a wall-lining seating platform formed by a horizontally projecting fold in said metal strip adjacent said wall-lining base retainer, and an upper wall-lining stabilizing leg depending downwardly directly beneath said wall-lining base retainer parallel to and transversely spaced from said shaft-lining stabilizing leg, providing at least one sheet of shaft-lining, fire-resistant wallboard at each of said levels, placing a layer of nonflammable fire insulation above said at least one sheet of shaft-lining, fire-resistant wallboard, inserting the top of said at least one sheet of shaft-lining, fire-resistant wallboard up between said shaft-lining stabilizing leg and said upper shaft-lining retainer of an upper level connector as aforesaid at the transition with the level immediately thereabove, securing said at least one sheet of shaft-lining, fire-resistant wallboard to said shaft-lining base retainer of a lower level connector as aforesaid at the transition with the level immediately therebelow, inserting a plurality of horizontally spaced, vertically oriented, upright metal studs, each having upper and lower ends, in between said channel webs of upper and lower level connectors, securing said lower ends of said upright metal studs to said shaft-lining base retainer of said lower level connector, securing said wall-lining stabilizing leg of said upper level connector to said upper ends of said metal studs, placing an underlying wall-lining wallboard panel atop said wall-lining seating platform and in contact with said wall-lining base retainer of said lower level connector and against said upright metal studs, placing an overlying wall-lining wallboard panel atop said wall-lining seating platform of said lower level connector and in contact with said underlying wall-lining wallboard panel so that said overlying panel extends upwardly beyond the upper extremity of said underlying panel to create a wall-lining insulation gap between said wall-lining wallboard panels and the underside of said wall-lining seating platform of said upper level connector that is greater above said underlying panel than above said overlying panel, securing said underlying and said overlying wall-lining panels to said upright metal studs, and filling said wall-lining insulation gap with a layer of nonflammable, resiliently compressible fire insulation.

15. A method according to claim 14 further comprising providing a pair of shaft-lining wallboard sheets as aforesaid residing in mutually facing contact throughout.

16. A method according to claim 14 further comprising forming a plurality of longitudinally spaced, vertically elongated fastener slots in said upper wall-lining stabilizing legs of said level connectors, whereby some of said vertically elongated slots are aligned with said upright metal studs, providing standoff washers at said vertically elongated slots aligned with said upright metal studs, and securing said wall-lining stabilizing leg of said upper level connector to said upper ends of said metal studs by driving sheet metal screws through said standoff washers and into said upper ends of said metal studs.

17. A method according to claim 14 further comprising configuring said wall-lining wallboard panels so that said overlying wall-lining wallboard panel extends upwardly beyond the upper edge of said underlying wall-lining wallboard panel a distance of about one inch.

* * * * *